United States Patent [19]

Hsiao

[11] 3,970,013

[45] July 20, 1976

[54] AUTOMATIC SAFETY STOP MECHANISM

[75] Inventor: James C. Hsiao, Chicago, Ill.

[73] Assignee: Union Special Corporation, Chicago, Ill.

[22] Filed: Mar. 31, 1975

[21] Appl. No.: 563,759

[52] U.S. Cl. ..... 112/67; 112/219 R

[51] Int. Cl.[2] ..... D05B 3/00

[58] Field of Search..... 112/67, 218, 110, 219 R, 112/252, 254

[56] References Cited

UNITED STATES PATENTS

| | | | |
|---|---|---|---|
| 1,544,739 | 7/1925 | Grieb | 112/67 X |
| 2,116,889 | 5/1938 | Gunther | 112/110 |
| 2,361,032 | 10/1944 | Ibbott | 112/67 |
| 2,440,227 | 4/1948 | Wood | 112/219 R |
| 2,609,773 | 9/1952 | Nelson | 112/254 |
| 3,509,838 | 5/1970 | Bowin | 112/252 |

*Primary Examiner*—H. Hampton Hunter
*Attorney, Agent, or Firm*—John A. Schaerli

[57] ABSTRACT

Stop mechanism which prevents actuation of the machine if an orientating means associated therewith has not returned to its proper position. This mechanism includes a series of levers which are forced into an abutting relationship with one another if the work cycle of the orientating means is not fully completed prior to full actuation of said machine.

6 Claims, 5 Drawing Figures

FIG. 2
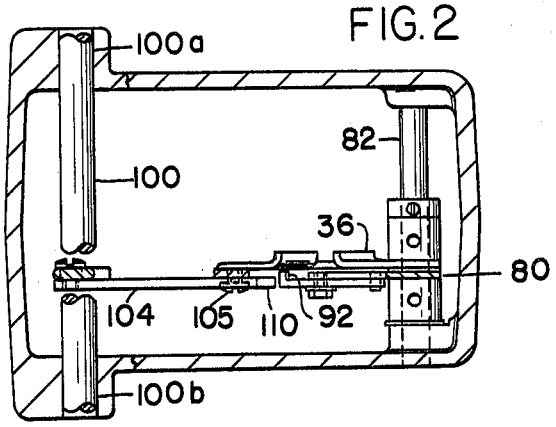
FIG. 4
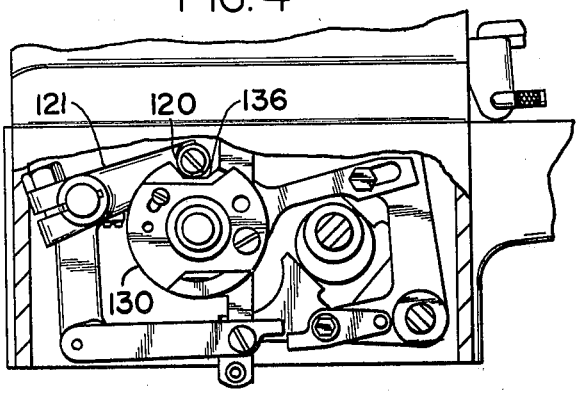
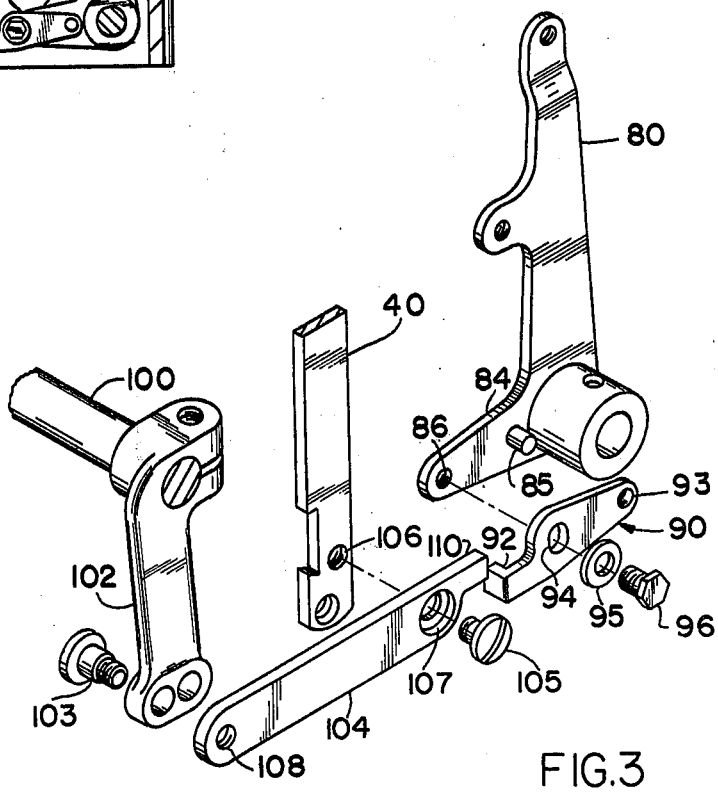
FIG. 3

AUTOMATIC SAFETY STOP MECHANISM

This invention relates to an improvement in a sewing machine and more particularly to a safety stop mechanism for sewing machines having article orientating mechanisms.

BACKGROUND OF THE INVENTION

This invention represents an improvement over such apparatus as disclosed in my other co-pending U.S. Pat. applications, Ser. No. 509,957 filed Sept. 27, 1974 and Ser. No. 521,432 filed Nov. 6, 1974. However, the invention is equally applicable, at least in part, to other types of sewing machines having article orientating means.

It sometimes happens that an article, such as a button, which is being processed through an orientating station may become jammed or it may be only partially fed into a delivering mechanism of the orientating station. The delivery mechanism under such conditions may be only partially indexed. Through carelessness or inattention, it sometimes happens that the operator will not notice such a state and will again try to cycle the machine through another operation. Before it is realized what has happened, the needle may strike the mechanism, thus breaking the needle along with possible damage that may be incurred to the indexing mechanism. The net result being possible injury to the operator plus damage of the machine and costly parts along with the loss of time due to repairs.

The present invention has for an object to provide an automatic safety stop mechanism which insures against damage to the operator and the machine by utilizing two levers which come into an abutting relationship with one another when the indexing mechanism has not been properly cycled or sequenced.

It is another object of the invention to provide a safety stop mechanism comprised of two levers wherein one lever is adjustable relative to the other, allowing for slight differences in the manufacture and assembling of the machines.

It is yet another object of the invention to provide aa safety stop mechanism which is simple and easily applicable to existing button position sewing machines without necessitating expensive machine alterations.

With the above and other objects in view that will hereinafter appear, the nature of the invention will be more clearly understood by reference to the following detailed description, the appended claims and the several views illustrated in the accompanying drawings.

SUMMARY OF THE INVENTION

The invention hereunder consideration is a mechanism for the automatic stopping of a sewing machine. This mechanism prevents actuation of the machine at the onset of the sewing cycle if the indexing means associated therewith has not been returned to its proper position.

The mechanism is comprised of two levers. One lever is connected to the actuating mechanism of the machine. The other lever cooperates with one member of the indexing mechanism which is driven off the main driving system of the machine. The first mentioned lever moves into and out of the arcuate path of the second lever during the sewing cycle of the machine. It should also be noted that these two levers are adjustable one relative to the other. When it occurs that the indexing mechanism is incorrectly positioned at the start of the sewing cycle, the safety stop mechanism will prevent actuation of the machine because of the two levers being forced into an abutting relationship with one another.

BRIEF DESCRIPTION OF DRAWINGS

FIG. 2 is a partial top view taken along line 2—2 of FIG. 1 showing the apparatus when the indexing mechanism is in its initial position.

FIG. 3 is an exploded perspective view of the automatic safety stop mechanism along with one member of the indexing mechanism.

FIG. 4 is a partial side view of the machine, similar to FIG. 1, showing a stop motion cam member.

DESCRIPTION OF THE PREFERRED EMBODIMENT

Figure 1:
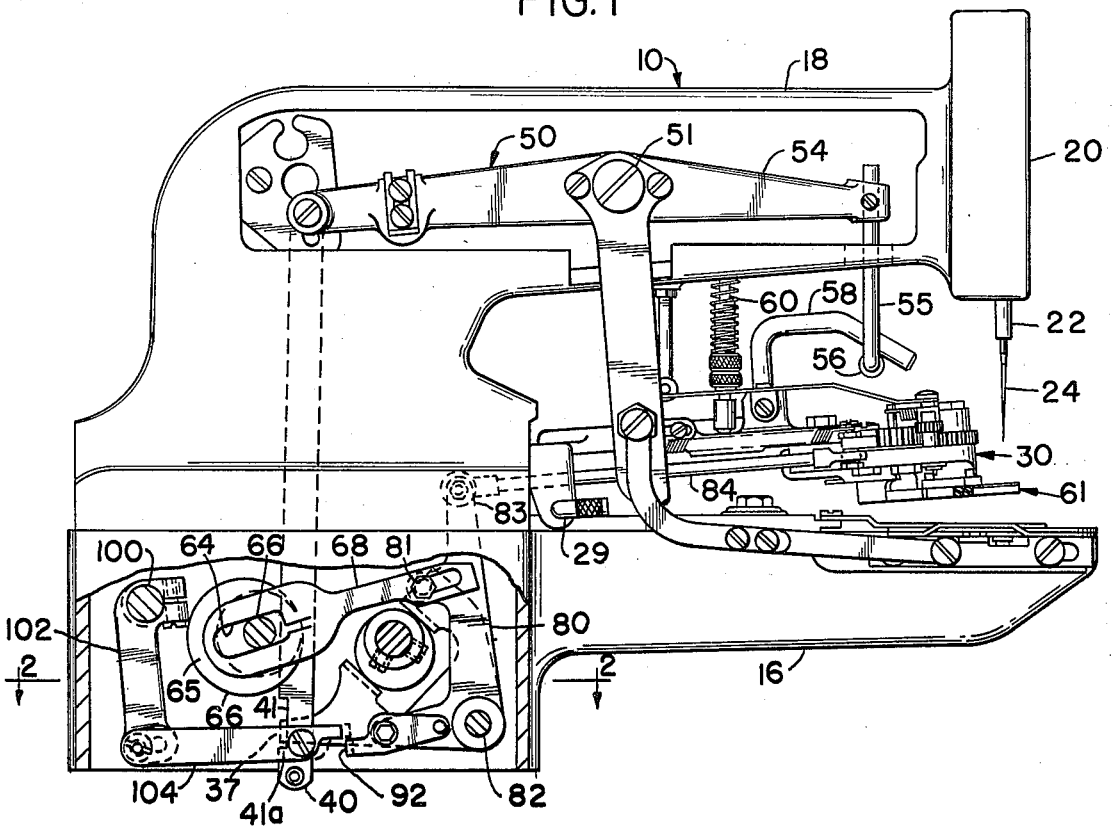
FIG. 1 is a side view of a button sewing machine partially broken away, showing the automatic safety stop mechanism hereunder consideration, part of which is secured to one member of the indexing mechanism.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

The sewing machine illustrated in the drawings wherein is embodied the present invention is a group stitch machine of the general type disclosed in: U.S. Pat. No. 2,609,773 to Nelson granted Sept. 9, 1962, and U.S. Pat. No. 3,509,838 to Bowin granted May 5, 1970, and U.S. Pat. No. 3,749,041 also to Bowin granted July 31, 1973. The type of machine shown in these patents is a button sewing machine that includes a positionable working clamping means. The work clamping means is moved into clamping engagement with a fabric at the beginning of the sewing cycle and is lifted away therefrom after a predetermined number of stitches have been employed to secure a button to the fabric or workpiece. A button can be either manually or mechanically positioned in the desired location to accomplish the sewing step. Accordingly, the showing of the machine here is greatly simplified and only certain key parts will be specifically referred to inasmuch as reference of specific details, etc., are disclosed in the above identified U.S. patents.

Figure 1A:
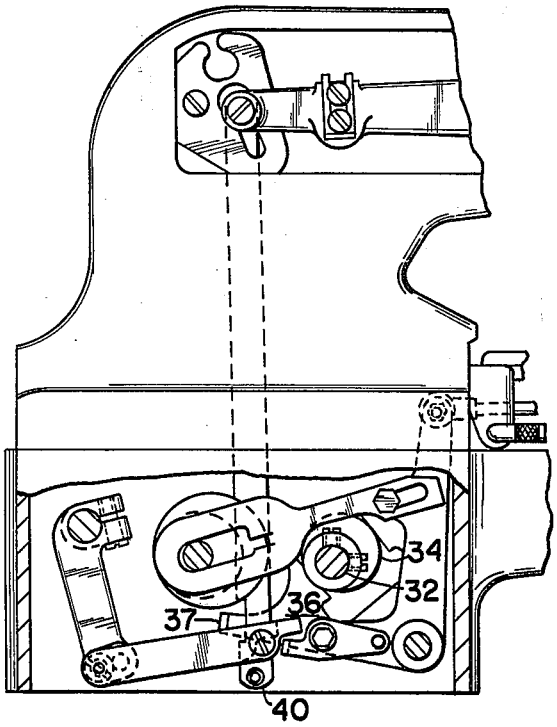
FIG. 1*a* is a partial view of FIG. 1 showing the apparatus in a position when the indexing mechanism is in an indexed position.

Referring now to the drawings and more particularly to FIGS. 1 and 1*a* wherein are shown a button sewing machine 10 which has an enclosed frame including a vertical stand means 12 having a subbase portion 14 which is arranged for mounting upon a suitable support (not shown). Extending horizontally and, for the purpose of this description, forwardly from the subbase portion 14 is a work supporting arm means 16. Above the work supporting arm means 16 and extending outwardly and forwardly from the vertical stand means 12 of the frame is an overhanging arm meanns 18. The forward end of the sewing machine is provided with a head portion 20 in which is mounted a vertical reciprocal needle bar means 22 adapted to carry a needle 24 for vertical reciprocatory movement in the head portion 20. As disclosed in substantial detail in the above-identified U.S. patent application Ser. No. 521,432, the fabric clamping means 26 has secured to its forward end thereof a button delivering and removing assembly means 30.

A main shaft means 32 is rotatably mounted in the subbase portion 14. As disclosed in my co-pending application Ser. No. 509,957, the sewing machine is provided with manually operated means which serve to actuate a plunger lever means which carries lever means whereby operating a conventional friction clutch connecting the main shaft means 32 with a power driven pulley.

Main shaft means 32 fixedly carries eccentric means 34, adapted to rock member means 36 back and forth through a suitable arc upon each revolution of the main shaft means 32. During stitch forming operations of the machine, the rocking of member 36 is idle and performs no function. However, upon completion of the group stitching the lower end of lever means 40 is shifted towards the left into the position shown in FIG. 1. At its lower end lever means 40 is provided with notch means 41 in the edge thereof forming shoulder means 41*a*. When lever means 40 is shifted into the position shown in FIG. 1 shoulder means 41*a* will lie in the path of a laterally extending portion 37 of rock member 36. At this time, the rocking of member means 36 by eccentric means 34 will cause downward movement of lever means 40. The upper end of lever means 40 is pivotly connected with one arm of lever means 50 which is rockable about a supporting pin or stud means 51. The forwardly extending end means 54 of lever means 50 carries a downwardly extending rod means 55, the lower end of which extends laterally and carries roller means 56 adapted to cooperate with the undersurface of a hook-shaped rod means 58 secured to the clamping means 26. The latter may be of the same character as that disclosed in the above mentioned Nelson patent. It may be adapted for rocking movement about a pin means 29, carried by the main frame of the machine. Normally, the clamping member means 26 is urged downwardly by a spring 60, but when the rod 55 is lifted upwardly and in turn lifts the rod 58 upwardly, this will rock the clamping member 26 about the axis of pin means 29 and will lift the button delivering and removing assembly 30, which is fixedly carried on clamp member means 26 away from the work.

The sequence means, or as shown a button delivering and removing assembly means 30 has mounted thereon a button conveyor means 61 which is rotatable through a work cycle, that is between an initial position and an indexed position. The driving force for rotating the button conveyor means 61 will now be described. As disclosed in detail in the Bowin U.S. Pat. No. 3,749,041, shaft means 66 is driven by a looper shaft (not shown) which is driven from the main shaft 32. Securely fastened to shaft means 66 is off-center cam means 65. Drive lever pusher means 68 has an elongated slot 64, journalled by drive shaft means 66. The drive lever pusher means 68 is secured in an adjacent sliding relationship with the off-centered cam means 65 such that a tab means 70 extending from one end of the elongated slot always maintains contact with the outer peripheral surface means 67 of the eccentric cam. As is apparent, when the eccentric cam means 65 passes through a complete revolution, the drive lever pusher means 68 will reciprocate from the left to the right, this movement taking place as long as the tab means 70 slides on the outer circumference means 67. The indexing drive force is transferred to drive lever means 80 via support pin means 81. Drive lever means 80 is pivotally mounted (FIG. 2) at first end means on shaft means 82. At second end means 83 (FIG. 1) is a horizontally extending connecting rod means which transfers the driving force to the button delivering and removing assembly 30.

In the operation of the machine, as the main shaft 32 is rotated it causes a rocking movement of member 36 as described above, but it also transmits motion as described above to shaft means 66 which rotates off-center cam means 65. Through appropriate linkage means 68 and 81 drive lever means 80 is forceably driven to the right. As described in greater detail in my copending application Ser. No. 521,432, the driving force from drive lever means 80 causes button conveyor means 61 to rotate between an initial position and an indexed position thus conveying an article through a sequence of steps.

The Automatic Safety Stop Mechanism, best shown in FIG. 3, comprises drive lever means 80, having at its lower end a laterally extending arm means 84 which has a fixedly secured pin means 85, and a threaded bore means 86. Secured to drive lever means 80 is lever means 90 which has a laterally offset portion means 92 at a first or left end and a bore means 93 at a second or right end. When assembled, member means 90 pivots about pin means 85 on drive lever means 80. To secure member means 90 to drive lever means 80 a locking means, comprised of washer means 95 and bolt means 96, are provided. Medially located on member means 90 is a vertical elongated slot means 94. Slot means 94 is designed for two purposes: (1) to take up the amount of clearance between link means 104 and the laterally offset portion means 92 of member means 90 when the operator changes the effective travel of drive lever means 80 and, (2) to compensate for differences in manufactured parts during the assembly of the machines.

Referring once again to FIGS. 1 and 1*a*, at its left extreme link means 104 is pivotally secured to arm means 102 by screw means 103 associating with threaded bore means 108 in link means 104. Arm means 102 is secured to shaft means 100 for movement therewith. At first end means 100a of shaft means 100 has mounted thereon a manually operated means (not shown) for actuating the machine. By this arrangement any movement of the manually operated means will be reflected in a linear displacement of link means 104. Further to the right link means 104 is pivotally secured to lever means 40 by screw means 105 which associates with threaded bore means 106 in lever means 40. Still further to the right, lever means 104 is provided with projecting finger means 110 which is designed in such a configuration that in the error-free operation of the machine finger means 110 will hurdle the preset position of the laterally offset portion means 92 of member means 90 allowing actuation of the machine to take place.

At the completion of sewing cycle the button conveyor means 61 is returned to its initial position under the influence of spring means 86. This is accomplished in the manner shown in the above pending application Ser. No. 521,432. Once the spring acts upon the button conveyor means 61 it forceably drives connecting rod 84 to the left, forcing drive lever means 80 to pivot about shaft 82 returning it to a position as shown in FIG. 1.

Upon the starting of the next cycle, the lower end of lever means 40 will be swung to the right to carry the shoulder means 41a out of the path of the laterally extending portion means 37. This is accomplished in the manner shown in the above mentioned patent to Nelson. As there disclosed, the starting of the machine by the operator's action upon the foot treadle or knee press will bring about counterclockwise rocking of shaft means 100. Upon oscillation of shaft means 100 lever means 104 is forceably moved to the right. Initial movement of link means 104 is in a straight line path as shown by dotted lines in FIG. 1. Link means 104 is confined to such a path at the beginning because of extending portion means 37 riding on shoulder means 41*a* not allowing lever means 40 to rise.

Once shoulder means 41*a* is clear of the laterally offset portion means 37, lever 40 is forceably moved up due to the downward pressure exerted by spring means 60. In forceably moving lever means 40 upward it carries link means 104 into a position as shown in FIG. 1*a*.

It is to be understood that the motion of link means 104 is continuous and does not remain at the position shown in dotted lines for any significant amount of time.

Secured to the shaft means 66 is disk means 130, which has on its periphery, notch means 136. Cooperating with that notch is roller means 120 carried by an arm means 121 clamped, or otherwise secured to second end means 100b of shaft means 100. It will be seen that when the disk 130 begins to rotate, as a result of the operation of the manually operated means, the roller 120 will be held outwardly in the position into which it has been shifted by the rocking of shaft means 100. This allows continued rotation of disk means 130 because roller means 120 is free from notch 136. Operation of the manually operated means brings about the shifting of the lever 40 and also the shift of stop lever means 104 towards the right (FIG. 1*a*). Because of the roller 120 riding on the circumfrence of disk means 130 the shaft 100 will remain in this rocked position until the disk means 130 completes a revolution and brings the notch means 136 back into slignment with roller means 120. When this occurs a clockwise oscillation of shaft means 100 will occur forceably moving arm means 102 to the left. By returning arm means 102 to the left it carries shoulder means 41*a* into a position so that it may be engaged by the laterally extending portion means 37 of member means 36. This action returns the mechanism into a position as shown in FIG. 1 ready for another sewing cycle.

As mentioned earlier, upon the actuation of the machine, lever means 40 is swung to the right. When lever means 40 is swung to the right it carries with it stop motion lever means 104. Stop motion lever means 104 has finger means 110 designed in such a manner that in the error-free operation of the machine finger means 110 will just barely clear the adjustable preset position of laterally offset portion means 92 of member 90. Clearance over stop motion lever means 90 allows continued oscillation of shaft means 100 by the manually operated means whereby roller means 120 is raised sufficient height out of notch means 136 thus allowing cam means 130 to rotate. Stop motion lever means 90 is rotated into an underlying relationship with stop motion lever means 104 upon the actuation of drive lever means 80. At the end of the sewing cycle stop motion lever means 90 is returned to its initial position due to the action of spring 86 upon connecting rod means 84 whereby forcibly moving the drive lever means 80 back to its extreme left position.

It should be noted once again that the conveyor means 61 is rotatable through a work cycle, that is between an initial position and an indexed position. If for any reason the button conveyor has not reached its indexed position or an article has jammed preventing the button conveyor from returning to its initial position and if the spring action force which normally forcibly returns the drive lever means to its initial position is not of sufficient force to overcome the jam then the button conveyor will remain in a position between its initial position and its indexed position. When this situation occurs it should be apparent that the stop motion stop lever means 90 will also remain in a position corresponding to the position of the button conveyor.

If the operator, not noticing that something is wrong, tries to initiate the next sewing cycle she will find that initiation of the next cycle is unattainable. This is because when the stop motion lever means 90 is in other than its initial position the laterally offset portion of said lever will lie in an abutting relationship (FIG. 2) with finger means 110 on stop motion lever means 104. When this abutting relationship occurs stop motion lever means 104 is prevented from any linear movement, because of portion 92 lying in its path of movement whereby oscillation of shaft means 100 is unattainable. Since shaft 100 cannot be oscillated the conventional friction clutch means, mounted on the first end means 100*a* of shaft means 100 is prevented from engaging the power driven pulley with main shaft means 32 thus actuation of the machine is prevented, causing the automatic stopping of the machine at the very onset of the sewing cycle.

Thus it is apparent that there has been provided, in accordance with the invention, an Automatic Safety Stop Mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sewing machine having a main shaft means,
work clamping means;
lever means for raising and lowering said work clamping means;
article indexing means movable through awork cycle;
force transfer means operable from the main shaft whereby indexing an article;
manually operated means actuating said machine wherein the improvement comprises:
safety stop means including:
first lever means operable between first and second positions;
said first lever means cooperating with at least one member of the force transfer means,
second lever means moving into and out of the path of movement of said first lever means; and
said second lever means connected to and controlled by the movement of said raising and lowering means and said manually operated means whereby said first lever means lies in an abutting relationship with said second lever means preventing the movement of said second lever means into its operative position when said article indexing means is not moved through said predetermined cycle.

2. The sewing machine of claim 1 wherein said first lever means is pivoted at one end and underlies said second lever means at said other end thereby allowing said second lever means to attain its operative position when said indexing means is returned to its initial position.

3. The sewing machine of claim 1 including adjustable means whereby said first lever means can be positioned and locked against movement relative to said second lever means.

4. The sewing machine to claim 1 wherein the path of movement of said first lever means is an arcuate path.

5. Sewing machine assembly including a needle means comprising:

work clamp means;

means operative for raising and lowering said work clamp;

article indexing means capable of moving an article through a predetermined cycle with respect to said needle;

main shaft means driving said sewing machine through a work cycle having stop, start and run periods;

means operative to transfer force from said main shaft to said indexing means;

second lever means following said main shaft means in a predetermined manner; and first lever means following said article indexing means and engaging said second lever means when said main shaft is in said start period when said article indexing means is incorrectly indexed.

6. Sewing machine operable through a sewing work cycle including stop, start and run periods;

an article indexing means associated with said sewing machine operable through a predetermined work cycle; and a safety means including a second lever means following said sewing work cycle and a first lever means following said indexing means whereby said lever means engage when said sewing machine is in said start period and said indexing means is improperly cycled.

* * * * *